US007143932B2

(12) United States Patent
Wang

(10) Patent No.: US 7,143,932 B2
(45) Date of Patent: Dec. 5, 2006

(54) FOLDING COLLAPSIBLE STORAGE BOX

(76) Inventor: Wen-Tsan Wang, PO Box 82-144, Taipei (TW)

( * ) Notice: Subject to any disclaimer, the term of this patent is extended or adjusted under 35 U.S.C. 154(b) by 480 days.

(21) Appl. No.: 10/671,676

(22) Filed: Sep. 29, 2003

(65) Prior Publication Data

US 2005/0067474 A1 Mar. 31, 2005

(51) Int. Cl.
*B65D 5/36* (2006.01)
*B65D 5/56* (2006.01)

(52) U.S. Cl. ..... 229/117.35; 220/495.1; 220/495.11; 229/117.01

(58) Field of Classification Search ..... 229/117.01, 229/117.02, 117.03, 117.27, 117.35; 220/495.06, 220/495.08, 495.1, 495.11, 908; 383/119; 248/97

See application file for complete search history.

(56) References Cited

U.S. PATENT DOCUMENTS 1,176,755 A * 3/1916 Heinrich ..... 229/117.01
2,062,617 A * 12/1936 Steen ..... 383/119
2,673,454 A * 3/1954 Gallie et al. ..... 220/495.06
4,260,004 A * 4/1981 Domke ..... 190/110
4,679,242 A * 7/1987 Brockhaus ..... 383/4
4,765,579 A * 8/1988 Robbins et al. ..... 220/908
4,925,056 A * 5/1990 McCoig ..... 220/495.1
5,105,969 A * 4/1992 Lamas ..... 229/117.35
5,314,151 A * 5/1994 Carter-Mann ..... 248/100
5,411,165 A * 5/1995 Ellis ..... 220/495.08
5,887,748 A * 3/1999 Nguyen ..... 220/495.08
6,234,677 B1 * 5/2001 Mogil ..... 383/110
6,918,505 B1 * 7/2005 Gifford, Sr. ..... 220/495.1
2002/0179608 A1 * 12/2002 Prell et al. ..... 220/495.11

FOREIGN PATENT DOCUMENTS

FR 2625482 A1 * 7/1989

* cited by examiner

*Primary Examiner*—Gary E. Elkins
(74) *Attorney, Agent, or Firm*—Leong C. Lei

(57) ABSTRACT

A folding collapsible storage box is constructed to include a folding collapsible outer box, the outer box having front and back panels respectively internally reinforced with a rigid plate member and two opposite side panels respectively internally reinforced with two rigid plate members and bilaterally connected between the front and back panels, each side panel having a folding line extended between top and bottom sides thereof on the middle between the respective two rigid plate members, and an collapsible inner box inserted into the inside of the outer box, the inner box having two handle loops bilaterally disposed at a top thereof, and two handles respectively fastened to the handle loops, each handle having a clamping portion respectively clamped on the topmost edge of the outer box.

2 Claims, 5 Drawing Sheets

FOLDING COLLAPSIBLE STORAGE BOX

BACKGROUND OF THE INVENTION

1. Field of the Invention

The present invention relates to a storage box for keeping things and, more particularly, to a folding collapsible storage box which comprises an outer box, and an inner box that can be used independently or with the outer box as desired.

2. Description of the Related Art

Various folding collapsible storage containers have been disclosed, and have appeared on the market. There is known a storage container made of soft fabric and supported in shape with a support frame, which is comprised of horizontal bottom rods, horizontal top rods, and vertical rods spaced between the horizontal bottom rods and the horizontal top rods at the four corners. Further, the peripheral side panels of the storage container each have a crossed folding line through which the storage container can easily be folded up and set into a flat manner. This folding collapsible storage container has a complicated structure. It is also not easy to set the folding collapsible storage container between the operative status and the collapsed status. Besides, the rod members do not support the peripheral side panels of the storage container in a stretched manner, i.e. the fabric peripheral side panels of the storage container are constantly disposed is a loosed status. In case the storage container is equipped with a handle or handles, the handle(s) may hinder the folding of the storage container. Further, this structure of storage container has only a limited space for keeping things.

SUMMARY OF THE INVENTION

The present invention has been accomplished under the circumstances in view. It is one object of the present invention to provide a storage box, which is folding collapsible. It is another object of the present invention to provide a folding collapsible storage box, which has a simple structural design. It is still another object of the present invention to provide a folding collapsible storage box, which keeps the handles from sight. It is still another object of the present invention to provide a folding collapsible storage box that can be separated into multiple boxes for keeping more things.

According to one aspect of the present invention, the folding collapsible storage box is comprised of an outer box and an inner box detachably mounted inside the outer box. According to another aspect of the present invention, the outer box has the front and back panels respectively internally reinforced with a rigid plate member and the two opposite side panels respectively internally reinforced with two rigid plate members and bilaterally connected between the front and back panels, each side panel having a folding line extended between the top and bottom sides on the middle between the respective two rigid plate members; the inner box is made of soft fabric, having two handle loops bilaterally disposed at a top thereof, and two handles respectively fastened to the handle loops, each handle having a clamping portion respectively clamped on the topmost edge of the outer box. According to still another aspect of the present invention, the inner box has top extension portions that are turned inside out and covered on the outside wall of the outer box over the handles to keep the handles from sight.

DETAILED DESCRIPTION OF THE PREFERRED EMBODIMENT

Figure 1:
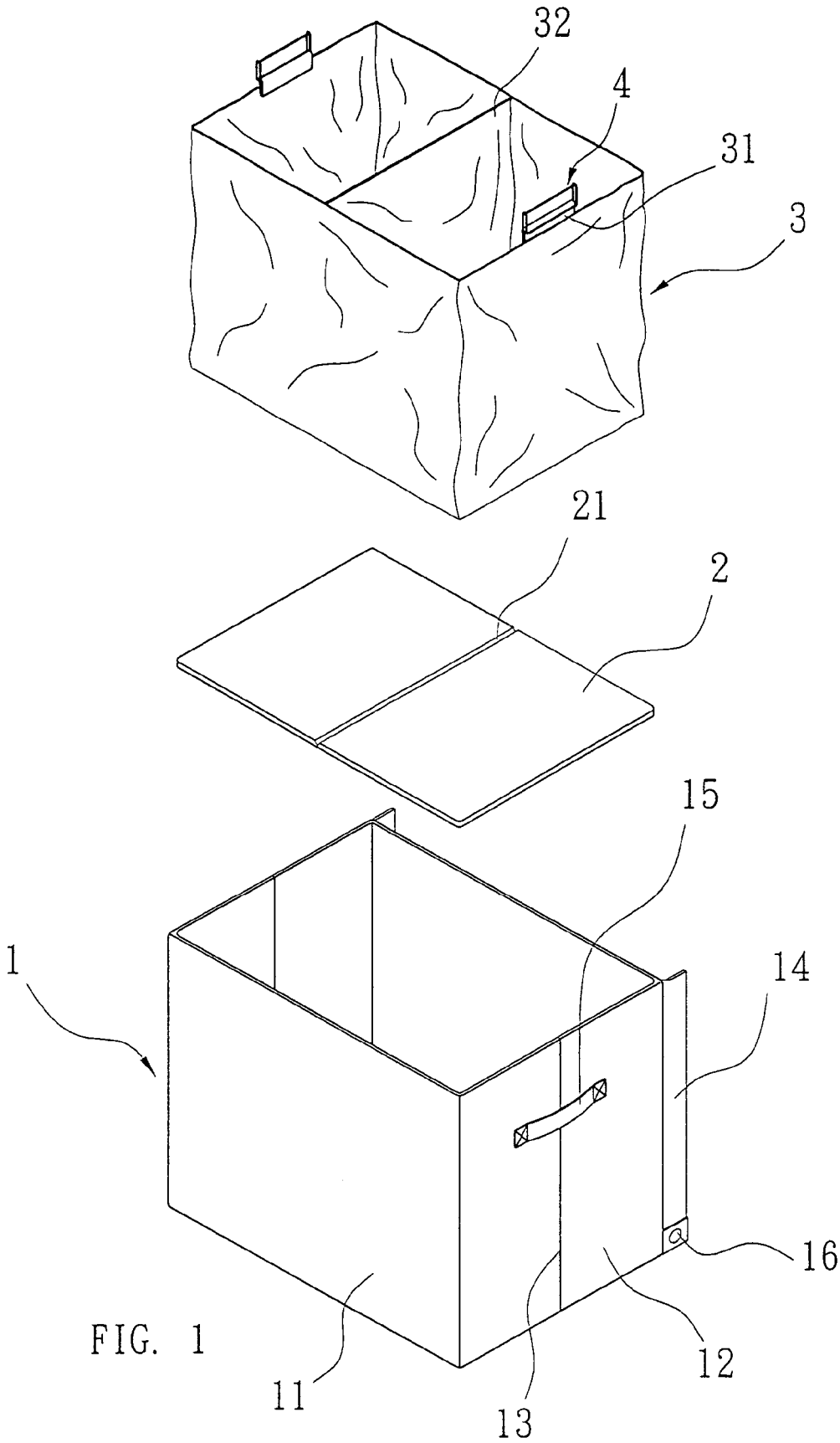
FIG. 1 is an exploded view of a folding collapsible storage box according to the present invention.

Referring to FIG. 1, a folding collapsible storage box in accordance with the present invention is shown comprised of an outer box 1, a bottom plate 2, and an inner box 3.

Figure 3:
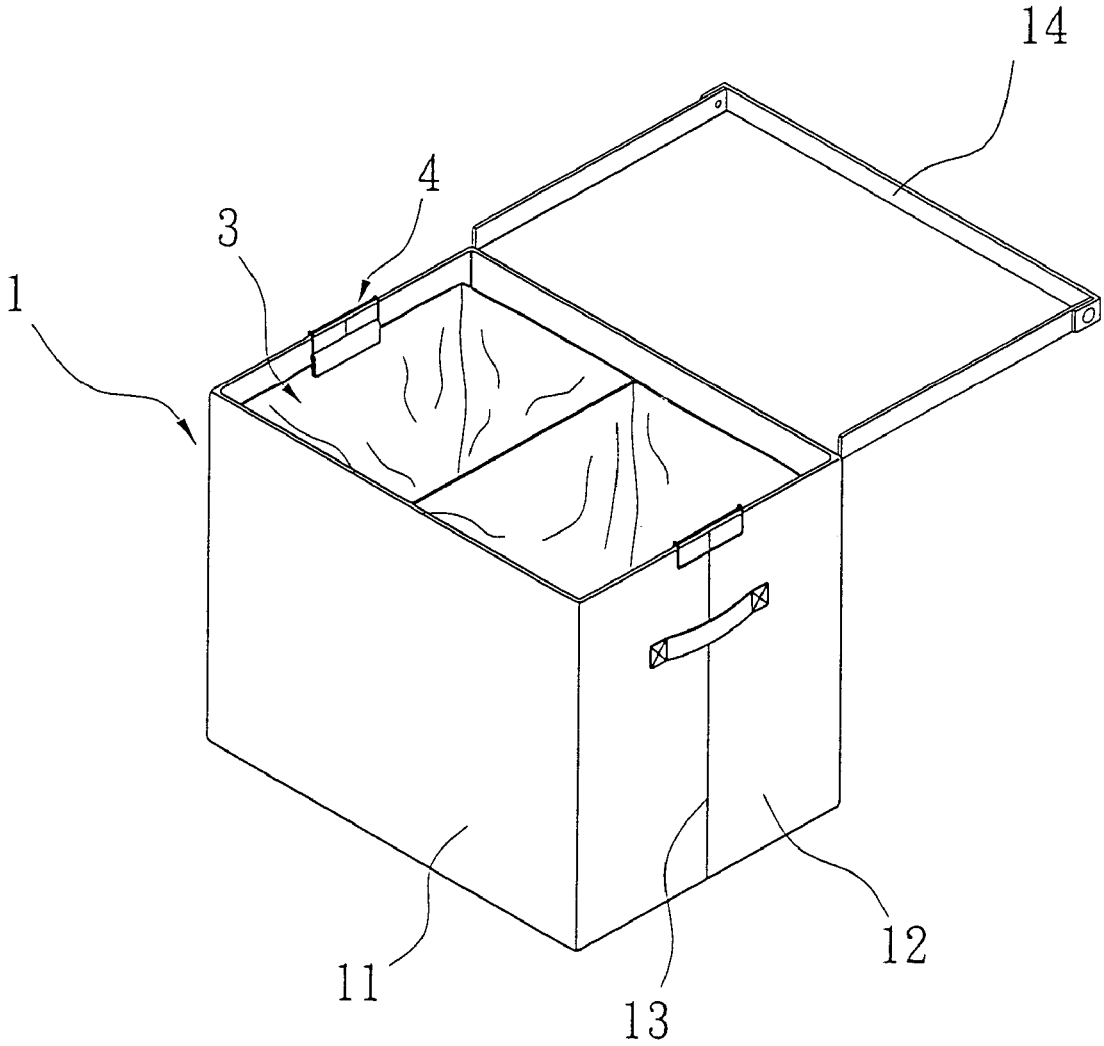
FIG. 3 is a perspective assembly view of the folding collapsible storage box according to the present invention, showing the opening status of the cover panel.

The outer box 1 is a collapsible hollow rectangular, top-open container made of soft sheet material, for example, canvass, having front and back panels 11 respectively internally reinforced with a rigid plate member (not shown), two side panels 12 respectively internally reinforced with two rigid plate members and bilaterally connected between the front and back panels 11, each side panel 12 having a folding line 13 extended between the top and bottom sides on the middle between the respective two rigid plate members, two handles 15 respectively provided at the side panels 12 and respectively bridging the folding line 13 of each side panel 12, and a cover panel 14 fastened to the top side of one of the front and back panels 11 and adapted to close the top open side of the outer box 1. Through the folding lines 13 at the side panels 12, the outer box 1 can be set into a collapsed flat manner (see FIG. 4). The cover panel 14 has three peripheral flanges that are connected to one another by snaps 16 (see FIGS. 1 and 3).

The rigid bottom plate 2 is a rectangular plate inserted into the outer box 1 to support the outer box 1 in shape, having a folding line 21 transversely extended between two opposite long sides on the middle. By means of the folding line 21, the rigid bottom plate 2 can be folded up (see FIG. 4).

Figure 2:
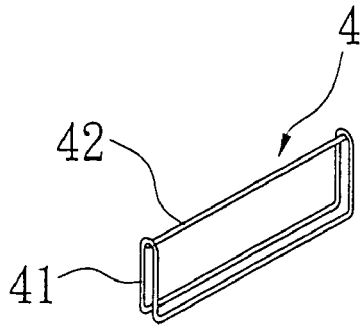
FIG. 2 is an elevational view of a handle for the inner box of the folding collapsible storage box according to the present invention.

The inner box 3 is a collapsible hollow rectangular, top-open container made of soft sheet material, for example, canvass, having at least one partition panel 32 that divides the holding space of the inner box 3 in a plurality of storage chambers, two handle loops 31 bilaterally disposed at the top, and two handles 4 respectively fastened to the handle loops 31, which are fastened to the inner box 3 by stitching. The handles 4 are preferably made by bending a respective metal wire rod into shape, each having a mounting frame 41 coupled to one handle loop 31 of the inner box 3, and a clamping frame 42 at one side of the mounting frame 41 (see FIGS. 1 and 2). Alternatively, the handles 4 can be directly injection-molded from plastics. After insertion of the inner box 3 into the inside of the outer box 1, the clamping frames 42 of the handles 4 of the inner box 3 are respectively clamped on the side panels 2 of the outer box 1 over the folding lines 13 at the side panels 2, holding the side panels 2 of the outer box 1 in the extended position (see FIG. 3).

Figure 4:
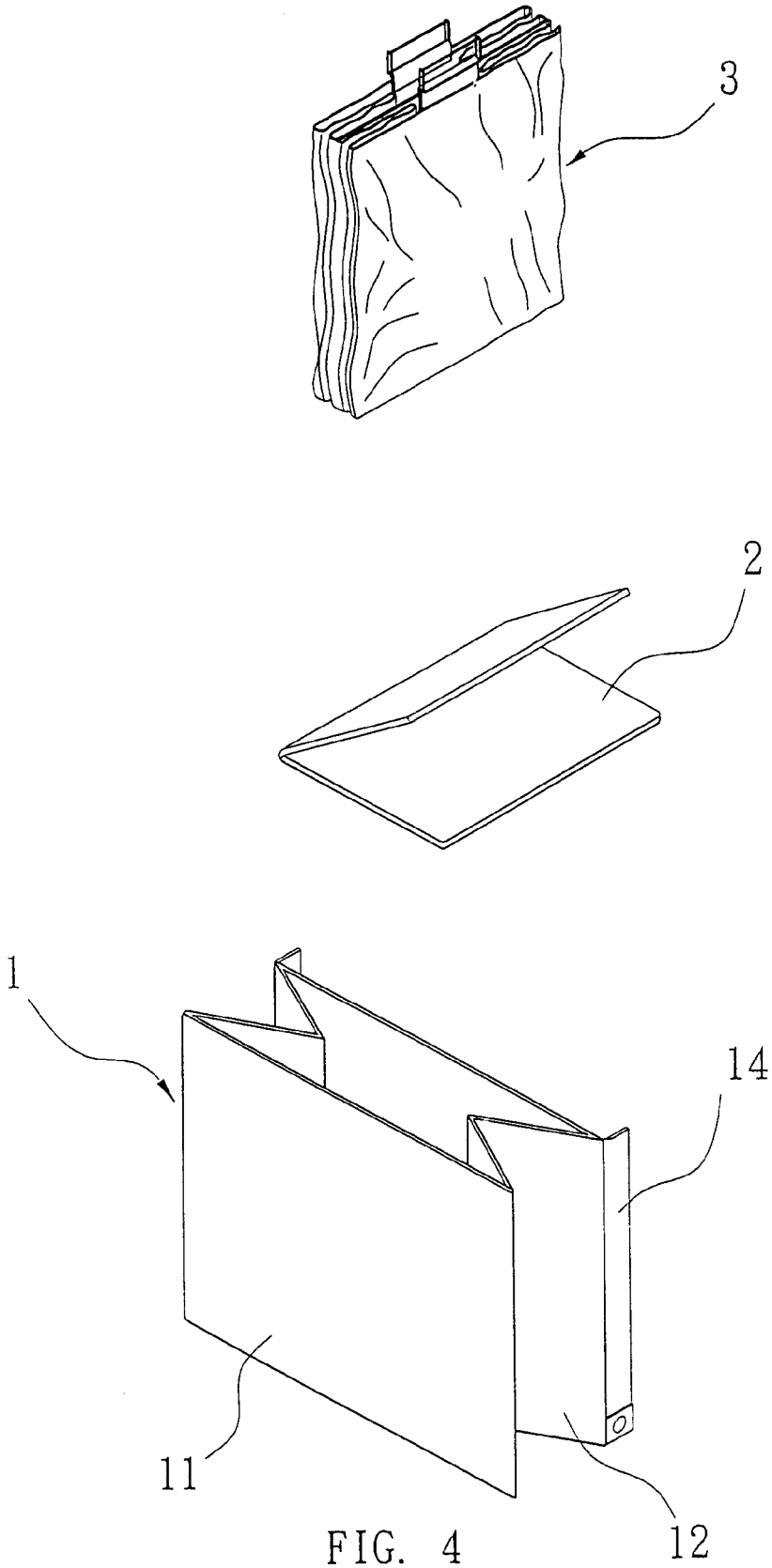
FIG. 4 illustrates the folding status of the inner box, the bottom plate, and the outer box according to the present invention.

When not in use, as shown in FIG. 4, the inner box 4 is taken out of the outer box 1 and arranged into a flat manner, and then the bottom plate 2 is removed from the outer box 1 and folded up, and then the outer box 1 folded into a collapsed flat manner.

Figure 5:
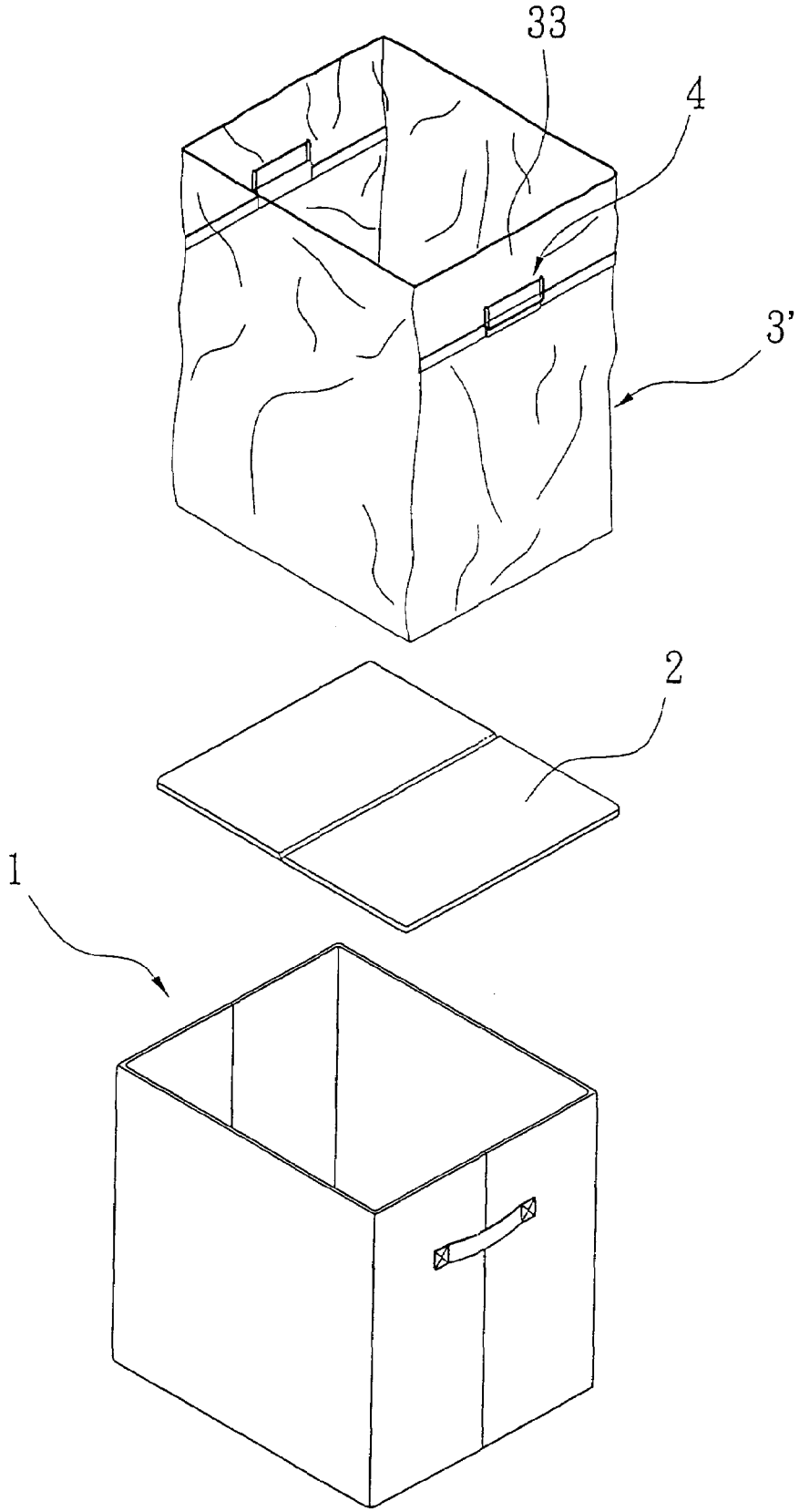
FIG. 5 is an exploded view of an alternate form of the folding collapsible storage box according to the present invention.
Figure 6:
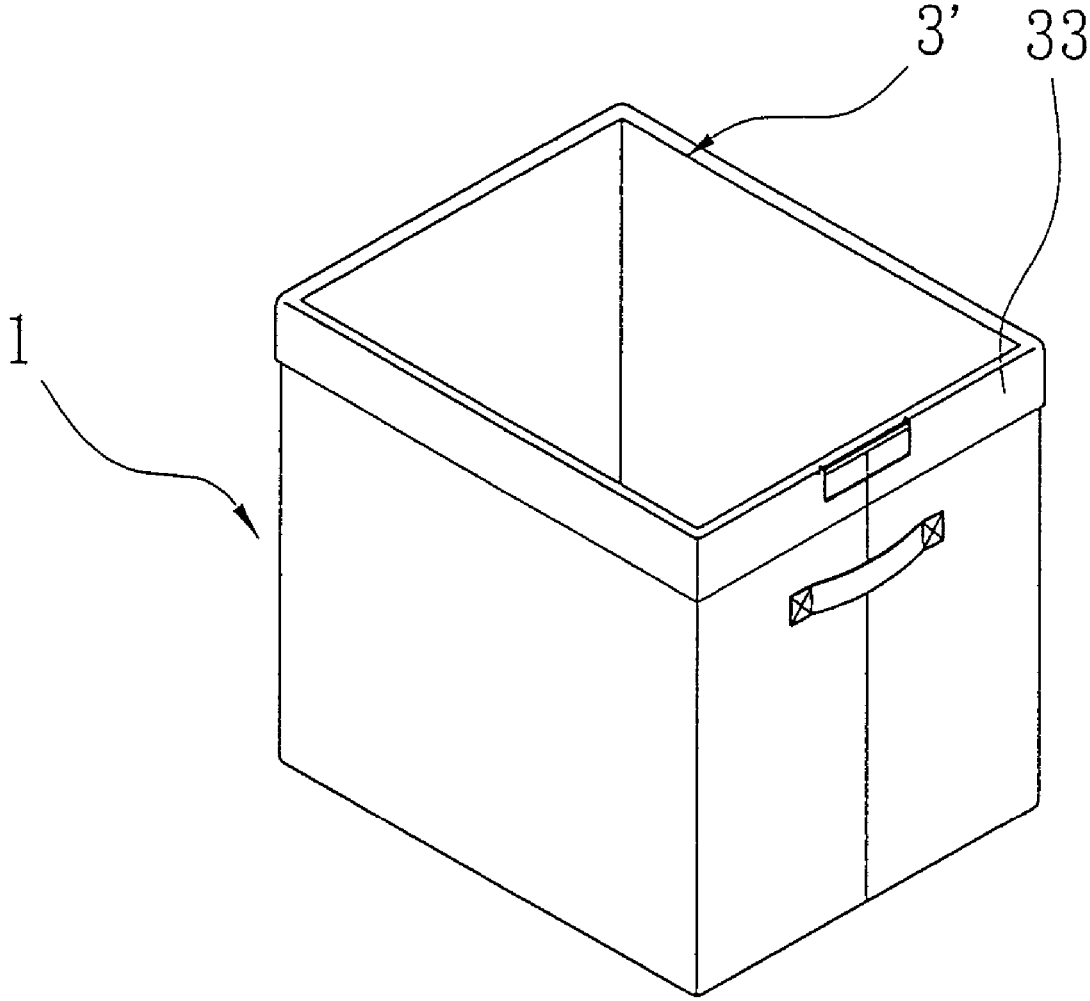
FIG. 6 is a perspective assembly view of the folding collapsible storage box shown in FIG. 5.

FIGS. 5 and 6 show an alternate form of the present invention. According to this embodiment, the inner box 3' has a top extension portion 33 extended upwards over the elevation of the handles 4. After insertion of the bottom plate 2 and the inner box 3' into the inside of the outer box 1, the handles 4 are respectively clamped on the top edge of the outer box 1, and then the top extension portion 33 is turned inside out and covered on the outside wall of the outer box 1 over the handles 4, keeping the handles 4 from sight.

Although particular embodiments of the invention have been described in detail for purposes of illustration, various modifications and enhancements may be made without departing from the spirit and scope of the invention. Accordingly, the invention is not to be limited except as by the appended claims.

The invention claimed is:

1. A folding collapsible storage box comprising:

an outer box, said outer box being a collapsible hollow rectangular, top-open container made of soft sheet material, having front and back panels respectively internally reinforced with a rigid plate member, two side panels respectively internally reinforced with two hinged rigid plate members and bilaterally connected between said front and back panels, each said side panel having a folding line extended between top and bottom sides thereof on the middle between the respective two rigid plate members, said outer box comprising two handles respectively provided at said side panels and respectively bridging the folding line of each said side panel; and an inner box inserted into the inside of said outer box, said inner box being a collapsible hollow rectangular, top-open container made of soft sheet material, having two handle loops bilaterally disposed at a top thereof, and two handles respectively fastened to said handle loops, the handles of said inner box each having a clamping portion respectively clamped on the topmost edge of said outer box.

2. The folding collapsible storage box as claimed in claim 1, wherein said outer box further comprises a cover panel fastened to the topmost edge of one of said front and back panels.

* * * * *